US007600354B2

(12) United States Patent
Knauseder

(10) Patent No.: US 7,600,354 B2
(45) Date of Patent: Oct. 13, 2009

(54) PANELS COMPRISING INTERLOCKING SNAP-IN PROFILES

(75) Inventor: Franz Knauseder, Wals (AT)

(73) Assignee: Kaindl Flooring GmbH (AT)

( * ) Notice: Subject to any disclaimer, the term of this patent is extended or adjusted under 35 U.S.C. 154(b) by 237 days.

(21) Appl. No.: 10/561,106

(22) PCT Filed: Jun. 23, 2004

(86) PCT No.: PCT/EP2004/051214

§ 371 (c)(1),
(2), (4) Date: Dec. 16, 2005

(87) PCT Pub. No.: WO2005/003489

PCT Pub. Date: Jan. 13, 2005

(65) Prior Publication Data

US 2006/0156670 A1 Jul. 20, 2006

(30) Foreign Application Priority Data

Jul. 2, 2003 (DE) ..... 203 10 178 U

(51) Int. Cl.
*E04B 2/00* (2006.01)

(52) U.S. Cl. ..... 52/592.2; 52/591.1; 52/578

(58) Field of Classification Search ..... 52/589.1, 52/590.2, 590.1, 592.1, 592.2, 592.3, 536, 52/541, 591.1, 591.4, 591.5, 592.6
See application file for complete search history.

(56) References Cited

U.S. PATENT DOCUMENTS

| | | | | |
|---|---|---|---|---|
| 2,016,382 | A * | 10/1935 | McBurney | 52/570 |
| 6,647,690 | B1 * | 11/2003 | Martensson | 52/601 |
| 2003/0101681 | A1 | 6/2003 | Tychsen | |
| 2004/0168392 | A1 * | 9/2004 | Konzelmann et al. | 52/589.1 |
| 2005/0204676 | A1 * | 9/2005 | Weitzer | 52/578 |

FOREIGN PATENT DOCUMENTS

| | | | | |
|---|---|---|---|---|
| DE | 197 18 319 | A1 | 11/1998 | |
| EP | 1 215 351 | A2 | 6/2002 | |
| WO | WO02103135 | A1 * | 12/2002 | |
| WO | WO 2004/048716 | A1 | 6/2004 | |
| WO | WO2004/048716 | A1 * | 6/2004 | 52/589.1 |

* cited by examiner

*Primary Examiner*—Brian E Glessner
*Assistant Examiner*—Adriana Figueroa
(74) *Attorney, Agent, or Firm*—The Webb Law Firm

(57) ABSTRACT

The invention relates to locking elements that are designed in such a manner that they can adopt an initial position into which the boards are brought by especially lowering them in an exclusively vertical manner. A terminal position is achieved by especially subsequently displacing the panels along the common joint. In this position, the two panels can be interlocked in a manner perpendicular to the panel surface and parallel to the panel surface and at the same time perpendicular to the common connecting joint.

24 Claims, 5 Drawing Sheets

PANELS COMPRISING INTERLOCKING SNAP-IN PROFILES

Figure 1:
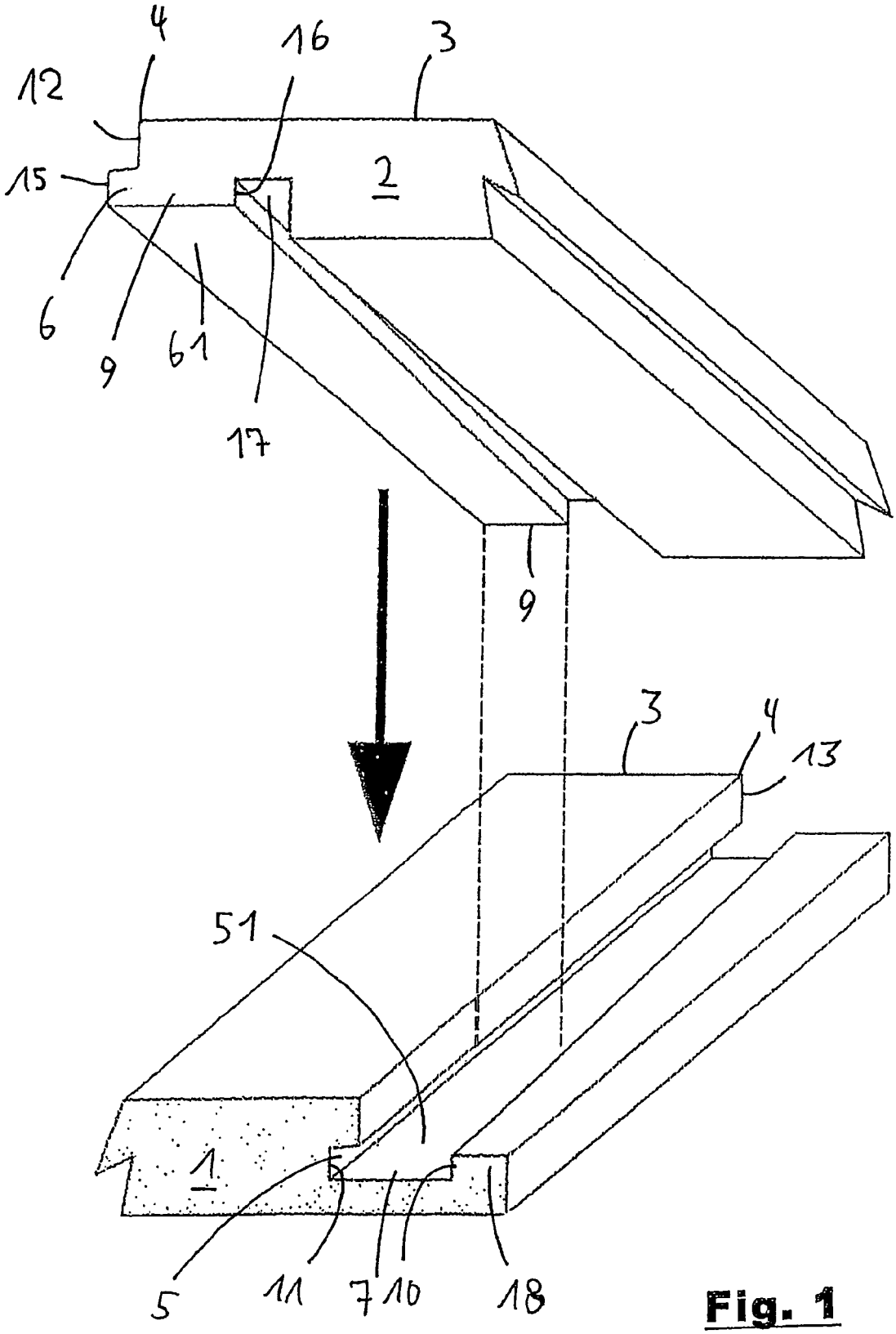

The invention relates to boards comprising laterally mounted locking elements.

A board of the type mentioned at the beginning is known under the term panel from printed publication EP 090 6994 A1. Generally, a panel is an oblong thin board which can be joined laterally, i.e. at the longitudinal and transversal sides, with other panels, for example by means of grooves and tongues. Panels connected in this manner are used in particular as floor covering or wall covering.

The connected panels are, for example, assembled to form a floor covering which is known as a laminate floor covering. The panels comprise a carrier board made of a derived timber product as well as a decorative paper on the top side together with a protection against abrasion.

In order to be able to avoid gluing, a plug-in profile for a panel is known from printed publication WO 96/27721 which, first of all, comprises grooves and tongues in the known manner. Furthermore, every tongue has on a top and/or bottom side at least one continuous protruding locking element. Every groove is provided with furrows such that the protruding locking element arrives in the corresponding furrow after two panels have been plugged together. An adhesive-free connection between two panels which is effected by positive fit is thus created. The use of adhesive is not necessary to assembly panels to form a floor or wall covering. Of course, it is nevertheless possible and in some cases—as in the present invention advantageous to use adhesive additionally.

It is known from printed publication WO 96/27721 to join two panels by displacement in one plane or by means of a rotational movement around the joint located between the panels.

Furthermore, adhesive-free connections between two boards are known, for example, from the printed publication OS 25 02 992, which are effected by a lowering. After the lowering, the boards are connected with each other in a positive fit.

In printed publication DE201 09 840 U1 a connection is proposed that is free from play which is effected by a displacing movement along the common connecting joint. The perpendicular locking that runs perpendicularly in relation to the common surface is in this case effected in a lateral groove-tongue connection by means of a rotational movement or an elastic yielding of material. The rotational movement requires a design of the lateral grooves and tongues which permits it. Where elastic material is used, the result is a lesser strength of the connection. It is also disadvantageous, in particular with respect to production engineering, that a lateral groove-tongue connection is necessary for vertical fixing and a groove-tongue connection that extends in a vertical direction is necessary for fixing in a parallel direction in relation to the surface of the board and, at the same time, perpendicularly in relation to the common connecting joint. The play-free connection by means of displacing is achieved in this case by arched, wave-like, serpentine or sawtooth-like shapes of the groove that are difficult to manufacture.

The idea of connecting two boards free of adhesive has been known for several decades, as can be seen from printed publications GB 1 430 423 or U.S. Pat. No. 5,295,341. For reasons of appearance and hygiene, the joints should not have any play between two panels, in particular in the flooring area, so that high demands must be made with regard to production tolerances. At present, the production tolerances should not amount to more than $1/10^{th}$ of a millimetre. These production tolerances were only realized successfully in practice in the recent past. That is why flooring panels that are connectable without the use of adhesives can only be sold successfully in the last four years.

Since the panels are manufactured from wood or a derived timber product, there is still movement within the material even after the products are finished. Panels may warp to such an extent that laying becomes practically impossible.

The invention is based on the object of providing improved boards that can be connected without the use of adhesives.

The object is achieved by means of a board having the features of one of the independent claims. Advantageous embodiments result from the dependent claims.

A board according to the claim comprises laterally mounted locking means with which two boards can be connected with each other laterally without adhesives. A connection of two boards without adhesives is present when they are connected in a positive fit 1. in a perpendicular direction relative to the surface of the boards, and 2. in a parallel direction relative to the surface of the boards and at the same time perpendicular relative to the common connecting joint.

In contrast to the state of the art, the locking elements are made such that there is an initial position into which the boards have to be brought in particular by only vertical lowering, wherein, in particular by subsequent shifting along the common joint, a final position can be reached in which a locking of the two boards can be effected in a perpendicular direction relative to the surface of the boards and parallel to the surface of the boards and, at the same time, perpendicular relative to the common connecting joint.

The displacement optionally takes place via an intermediate position where the boards or panels are interlocked by positive fit in at least one direction, but where there is play in the common joint. Because of the play, the boards can be pulled apart to a small extent (corresponding to the amount of play), namely in a perpendicular direction relative to the joint, and subsequently be pushed towards each other again—in a perpendicular direction relative to the joint—to a small extent. The locking elements are therefore threaded into one another so that the connection can be effected more easily and safely due to the locking taking place in different directions one after the other.

The locking elements are made such that a final position in which there is no play between the boards or panels is only reached by displacing. The aforementioned displacing due to a play in a perpendicular direction relative to the joint is not possible anymore in the final position. The advantage of the play also consists of the material being easier to process or assemble.

The two boards or panels are then displaced, in particular in a substantially parallel direction relative to the common joint, until the final position is reached. Then, there is no play left in the connecting joint. The locking elements are made in accordance with this purpose.

The invention does not require an exact production to create an adhesive-free connection between two boards because at first, there is a locking in at least one direction in which there is sufficient play. Preferably, there is an initial position in which the panels are locked by positive fit in both aforementioned directions and therefore are already connected with each other without adhesives. In contrast to the state of the art, the locking elements are made such that a play that still exists in the intermediate or in the initial position disappears between the joints.

In one embodiment, the play-free connecting of the boards along the narrow sides has a particularly advantageous effect on the behavior of the flooring assembled from the boards according to the invention. This has to do with the fact that the dimensions of the board change to a larger extend in longitudinal direction than in transversal direction in the event of changes in temperature. Thus, there is the danger in this case that the joints open up at the narrow sides which affects appearance and allows fluids to penetrate into the joints. In contrast, known profiles that allow a snap-in or engaging connection by displacing in the plane can be used on the longitudinal sides. In the event of a change in climate, i.e, in particular, changes in temperature and humidity, dimensional changes will arise such as shrinking and swelling. The adhesive-free connection is subjected to great stress especially in the event of shrinking. Generally, the panels are rectangular with a ratio (length:width) of 1:3 to 1:10, preferably about 1:8 to 1:6. The strength with which the panels adhere to each other is directly dependent on the length of the connection. Therefore, the narrow side is more vulnerable and must be designed to be more stable.

Therefore, the initial position can be reached particularly easily according to the invention because only the panel to be connected must be lowered onto the other panel in the area of the connecting means. In contrast to printed publication DE 201 09 840 U1, no initial rotating-in or providing of elastic materials that weaken the strength of the connection is required. According to the invention, it is not absolutely necessary to reach the intermediate position. It is also conceivable that the aforementioned horizontal and perpendicular locking takes place at the same time during the displacement along the common joint. Undercut wedge-shaped surfaces, e.g. similar to a dovetail, can preferably be provided. Such an embodiment is described in the context of FIG. 5.

Thus, a part of the upper panel lies on top of a part of the bottom panel in the initial position but can be moved vertically in one direction. In addition, the boards can be moved in all directions in the plane of the surface of the board. When the boards are moved along the connecting joint from the initial position into the final position during the process, this effects that no play occurs in the common joint and that the boards are connected with each other in a perpendicular direction relative to the surface of the board and in a direction parallel to the board and at the same time in a perpendicular direction relative to the common joint.

By designing the locking elements according to the invention or their cooperation it is furthermore achieved by displacing the first board against the second board along a first common connecting joint, that, simultaneously The first board can be connected with the second board in a positive fit along the first common joint both in a perpendicular direction relative to the surface of the board as well as in a parallel direction relative to the surface of the board and, at the same time, in a perpendicular direction relative to the common joint, and That the first board can be connected with the third board in a positive fit along a second common connecting joint at least in a perpendicular direction relative to the surface of the board.

The above-mentioned connections, for example, connections along the longitudinal and narrow sides of a panel, are usually effected one after the other and independently from one another. For example, the first board is at first connected with the second board in a positive fit on the narrow sides along the first common connecting joint, both in a perpendicular direction relative to the surface of the board as well as in a parallel direction relative to the surface of the board and, at the same time, in a perpendicular direction relative to the first common joint, and then displaced along the first joint towards the third board until a further connection is achieved at the longitudinal side between the first and third boards. Thus, it is neither necessary to rotate the boards relative to each other nor to manufacture at least parts of the boards from elastic materials.

The locking according to the invention by means of displacing along the common joint, instead of the known lockings by clicking or rotating has further advantages. A comparatively very great snap-together height and an optimal angle (90° to the surface of the board or dovetail-like) can be realized at a small thickness, without the occurrence of compression forces, shear forces, splitting forces or bending forces.

In this manner, the desired objects are realized, in particular the reliable adhesive-free connection independent of inaccuracies in production on the one hand and avoiding a play at the connecting joint on the other.

By means of the embodiments described below it will especially be explained why the play can be avoided independently from inaccuracies in production.

In one embodiment of the invention, one board has a groove and/or a tongue at its side. The tongue protrudes laterally, parallel relative to the surface of the board. The groove has been, for example, milled in laterally, parallel relative to the surface of the board. By pushing a tongue of a first board into the aforementioned groove of a second board, in particular by displacing the boards relative to each other, the two boards are connected in a known manner such that they are interlocked due to positive fit in a perpendicular direction relative to the surface.

The boards have further locking elements that make the connection in a positive fit in a parallel direction relative to the surface as well as in a perpendicular direction relative to the connecting joint possible. This is generally a second groove that was, for example, milled in in a perpendicular direction relative to the surface. The second groove can be provided on the bottom of the board or in the first-mentioned groove. It is known from the FIG. 1 of printed publication WO 94/26999 to provide such a groove on the bottom of the board.

In the other board, there is at least a second corresponding protruding locking element which arrives in the second groove when the boards are interlocked. According to the FIG. 1 of printed publication WO 94/26999, a locking strip protruding over the connecting edge of the associated board is provided for this purpose at the end of which the protruding locking element is arranged. When the corresponding protruding locking element arrives in the second groove, the two boards are also connected by positive fit such that the boards cannot be detached from each other by a displacement in a plane that is perpendicular to the common joint. In this initial position, there is the aforementioned play. Such a play is, for example, described in printed publication WO 94/26999 and denoted "Δ" in FIG. 1*a*. Such a play is also known from printed publication GB 2 256 023 A.

According to the invention, the second groove or the corresponding lateral boundary runs in such a way that a displacement of the boards in a parallel direction relative to the joint results in one board being moved towards the second board at the same time. This is always the case when the course is not formed parallel relative to the joint. This movement takes place until there is no play anymore. This is coordinated such that the panels are then also aligned. The connection is secured against slipping back or opening by the longitudinally adjacent panels.

In one embodiment, the course mentioned is realized by the course of the perpendicular groove and/or of the perpendicular locking element or of its external lateral boundaries, which may at the same time be the side wall of the second groove or of the second locking element, being formed wedge-shaped. This means that the distance of the aforementioned elements increases or decreases in a linear manner along the joint. The manufacture of such oblique partial surfaces which are hereinafter referred to as wedge-shaped, may for example be performed by a milling machine running in an oblique manner. Alternatively, in the kinematic inversion the board may also be shifted during milling. However, the use of a milling machine running in an oblique manner has the advantage that no additional movement of the board is necessary as, for example, in the manufacture or wave-shaped contours from DE 201 09 840U1.

Alternatively, the aforementioned course is realized by the lateral walls of the second groove running wave-like, serpentine-shaped or sawtooth-like. Here, the width of the groove can decrease. It is characteristic for this embodiment that the distance between the second groove and the adjacent groove varies. In an embodiment resembling the figures from WO 94/26999, the distance between the groove and the wall of the groove that is closer to the connecting joint than the other wall is of importance.

In these embodiments, the boards or panels are at first connected such that the protruding locking element or elements arrives in the second groove at a location which is situated close to the common joint. If one of the two boards is now displaced parallel to the common joint which is called connecting joint, the protruding locking element finally arrives in areas of the second groove that are further away from the connecting joint. Thus, the boards move towards each other more or less automatically at the same time until finally the play is eliminated. The final position is reached.

Given a wedge-shaped course, it is sufficient to lay the boards next to each other in an offset manner and then to displace them relative to each other in the direction of the connecting joint until the boards are aligned. Because of the wedge-shape, the boards will move towards each other more or less automatically at the same time until the play is eliminated in the final position. An offset of more than 50% and less than 100%, preferably of more than 66% and less than 80% allows for an easy handling at a great locking strength. A relatively small offset makes aligning and guiding the locking elements into the initial position easier.

At the same time, a large offset is desirable so that the displacement distance is large and thus the sliding surfaces that have been positioned next to each other and are, in particular, wedge-shaped, are able to guide the boards towards each other with great locking strength a distance that is as big as possible. The great closing strength provides for a better appearance of the joint and prevents dirt and moisture from entering in to the board's core. Given an optimum connection, impregnating and the like of the side edges may therefore be done without. A large distance permits a wedge-shape with a small angle which makes larger forces achievable. The embodiment specified according to the invention therefore is a particularly favorable compromise in practice.

In one embodiment, the boards can only be brought from the initial position towards the final position by displacement along the diagonal joint. Such a displacing movement requires less dexterity than known connecting techniques in which, for example, the side surfaces must be plugged into each other and/or rotated while manually maintaining a contact pressure.

In a further embodiment, the contact surfaces of the locking elements, in particular those that serve as sliding surfaces in displacing the boards relative to each other from the initial position into the final position, run in a perpendicular direction relative to the surface of the boards. The sliding surfaces which are under pressure therefore cannot deflect downwardly as is the case in such profiles which have oblique surfaces at those areas. An even higher safety against the surfaces shearing off can be achieved if the sliding surfaces are slightly undercut, for example like the dovetail that is explained with regard to FIG. 5.

In a further advantageous embodiment that is particularly easy to manufacture the lower surface of the tongue pressing sideways forms a flat surface together with the underside of the vertical locking element. The same is of course also true for the corresponding lateral and perpendicular grooves that are in contact therewith that are formed accordingly. In the initial position, the boards are therefore displaceable both in the direction of the connecting joint as well as in a perpendicular direction relative thereto which makes handling easier during the process of laying.

In a further embodiment of the invention, the first-mentioned groove comprises a protruding flank or lip. At the end of the protruding flank or lip, there is at least one protruding locking element which gets into the second groove when two boards are connected. By a lowering movement, the aforementioned initial position can be provided in which the two grooves or locking elements are guided into one another loosely at first.

As a rule, a substantially rigid protruding lip is to be preferred because in this case, the locking is particularly stable. This case is shown, for example, in FIG. 18 of the printed publication U.S. Pat. No. 4,426,820. In particular in this case the protruding locking element of the one board is located outside of the first-mentioned groove. The lower lip, compared to the one located above it, protrudes in a corresponding extent. The second groove at the other board then in places approaches the connecting joint to such an extent that the protruding locking element or elements get into the second groove by lowering the second groove of the one board in the direction of the protruding locking element or elements of the other board. There now is a locking by positive fit in a parallel direction relative to the surface and perpendicular relative to the connecting joint. There is not yet such a locking in the vertical direction.

If the displacing movement parallel to the connecting joint is effected subsequently, the boards will approach each other. The first mentioned laterally protruding tongue then gets into the first mentioned milled-in groove. It is only now that a vertical locking is effected. The continuation of the displacing movement finally leads to no play being present anymore in the connecting joint.

This embodiment is particularly easy to handle. Laying is possible without any problem even when several oblong panels are already connected at the narrow sides and when, together, they are to be connected with an already installed row of panels. In this case, the invention has substantial advantages in handling compared with panels that can be connected without adhesives which, on the narrow sides, must first be connected by means of a rotary movement, for example, because of a rigid protruding lip, before the longitudinal sides are connected in the same manner by a rotary movement. Such a state of the art with these disadvantages can be gathered from the printed publication U.S. Pat. No. 4,426,820.

In a further embodiment of the invention, further grooves may branch off from the second groove in the direction of the connecting joint and end here. Protruding locking elements can then be pushed through these branches from the outside in the direction of the second groove. Then, when they are located at the level of the second groove, the boards are displaced in a parallel direction relative to each other until the aforementioned initial position is reached. A further displacement in a parallel direction relative to the connecting joint would result in the final position being reached.

This embodiment of the invention is advantageous in cases where several panels are at first connected so that they form a row. With oblong panels, that is the case when the narrow sides are connected first. The connection at the narrow sides can be an adhesive-free connection according to the state of the art. It is preferably one with a protruding lower rigid lip or flank since such connections are particularly strong. In addition, the connecting joint is relatively short here so that production inaccuracies are less problematic. Then, the longitudinal sides are connected with each other by displacement within one plane. Finally, there is a particularly strong adhesive-free connection. Handling is very easy.

If panels are first connected with each other at the longitudinal sides, the connections at the narrow sides are in particular formed such that an adhesive-free connection is possible by displacement within one plane. Such a state of the art can for example be gathered from the patent AT 405 560 B. This state of the art discloses a laterally milled-in groove with two elastic flanks of equal length. The flanks form the lateral walls of the groove. A tongue is located laterally at a further panel. At the underside, in particular, the tongue has a protruding locking element. However, the protruding locking element may be also present alternatively or additionally at the top side of the tongue. Corresponding to this protruding locking element, in the aforementioned lateral groove, there is an additional second groove that is present one of the two flanks of the groove. The protruding locking element latches into the second-mentioned groove when the panels are connected with each other by displacement within a plane. If, in the tongue, there is one protruding locking element respectively on the top side and on the bottom side, corresponding thereto, there, in the lateral groove, one further groove, respectively, in the top and in the bottom flank.

The additional groove which is located in the flank of the first-mentioned groove, together with the protruding locking element effects the connection in a positive fit on the top or bottom side of the tongue, in a parallel direction relative to the surface of the panels and perpendicular relative to the connecting joint. Preferably, such an additional or second groove is only provided in the lower flank. Accordingly, the protruding corresponding locking element is then provided at the bottom side of the tongue. For it was found that a protruding locking element at the top side of the tongue together with a corresponding groove has an adverse effect on the appearance of the surface of the panel in thin boards. For it can happen quite easily that the protruding locking element may cause a pressure, for example because of production inaccuracies, which causes a sort of dent on the surface. A panel is thin within the sense of the invention if it is not thicker than 14 mm, in particular, if it is not thicker than 10 mm.

The aforementioned connection which, in particular, is intended for the narrow sides in an oblong panel, in another embodiment has a further laterally mounted upper groove on a panel together with a laterally mounted corresponding tongue on another panel. The upper groove is located above the tongue with the protruding locking element. Corresponding thereto, the upper tongue is located above the first-mentioned groove. Therefore, it is a "double-groove-tongue"-connection which interlocks two panels by positive fit in a perpendicular direction relative to the surface. The upper groove is less deep than the first-mentioned groove which is located beneath the upper groove. Correspondingly, the upper tongue is shorter in comparison to the tongue located beneath the upper tongue. This connection was found to be particularly stable for narrow sides. If the lateral connection is additionally glued or provided at the factory with adhesive which not activated until laying or thereafter, for example by pressure or heat, a particularly large contact surface is provided.

If gluing is intended in the double-groove-tongue connection, one or more recesses for receiving excess adhesive are preferably provided. By the recesses, cavities are provided within the connecting joint. In particular, such a cavity is provided between the upper groove-tongue-connection and the one located beneath it. Furthermore, one or every groove is preferably deeper than the corresponding tongue so that a cavity remains between the end of the tongue and the bottom of the groove. Furthermore, a recess may have a connecting joint on the bottom side of the panels beneath the first groove and the first tongue.

An embodiment of the connection to which the main claims relate will now be dealt with again in the following. The second groove is milled into the board from below. The lateral wall of the second groove which is closest to the connecting joint is preferably at least in part arch-shaped. The arch then runs such that the "center of the arch" is enclosed between the connecting joint and the arch. This means that, in the aforementioned final position, the protruding coupling element is located in an area of the second groove which at least approximates a parallel course of the groove relative to the connecting joint. In this manner, and undesired sliding back in the direction of the initial position is counteracted.

In a further advantageous embodiment of the invention, an adhesive which at least connects the second groove with the protruding locking element is provided in the area of the final position. The aforementioned undesired sliding back from the final position in the direction of the initial position is also avoided by means of the adhesive.

The adhesive has preferably been applied in the factory and is only activated by pressure or heat. For example, the adhesive can be encapsulated and applied in the second groove at a location where the protruding locking element will probably arrive in the final position. As soon as this is the case, the capsule will be destroyed by the resulting pressure and the elements are glued to each other. Alternatively, the components of a two-component adhesive can be disposed on protruding locking elements and second grooves. In the final position, the various components mix.

On the one hand, the cohesion is improved by the adhesive and on the other hand, the connecting joints are protected against entering moisture. If the emphasis is on moisture protection, a water repellent paste or sticky mass can be provided instead of an adhesive. In principle, such a water repellent paste or sticky mass is suitable in any adhesive-free connection to prevent moisture from entering into the connecting joints and thereby avoid resultant damages.

The contact surface or the walls that form the contact surface between the protruding locking element and the groove corresponding thereto preferably run perpendicular relative to the surfaces of the boards. For the purpose of illustration, reference is made to the subject matter of patent EP 843 763 B1. Here, the contact surface is slanted. The slant of the contact surface has the disadvantage, in particular in an elastic flank or protruding lip of a groove, that a panel can also slip out again under stress.

This disadvantage is avoided with the perpendicular contact surface. In the subject matter of the patent, a slanted contact surface is required in order to be able to connect two panels also without a play being present in the connecting joint. As can be seen inter alia in FIG. 1*a*, a perpendicular contact surface is known from WO 94/26999. However, this state of the art always discloses the perpendicular contact surface in combination with a play. Without such a play, it would not have been possible to connect two panels with the aforementioned perpendicular contact surfaces. Since, according to the invention, there is at first a play in the initial position, two boards or panels can be connected with each other despite the perpendicular contact surface. Thus, a slanted contact surface with the aforementioned disadvantages can be avoided without having to accept a play at the connecting joint.

In a further embodiment of the invention, the walls forming the contact surface are even undercut. Then, the contact surface again has a slant relative to the surface, but this slant runs inversely compared to the slanted contact surface from the subject matter of patent EP 843 763 B1. In the final position, an interlock is effected by means of this inverse slant such that an adhesive-free connection according to the invention is provided in this way alone.

Further advantages result from the following description and the enclosed drawing. The afore-mentioned features that are explained further may also be used singly or in any combination according to the invention. The exemplary embodiments mentioned are not to be understood as being final and have the character of examples.

Figure 2A:
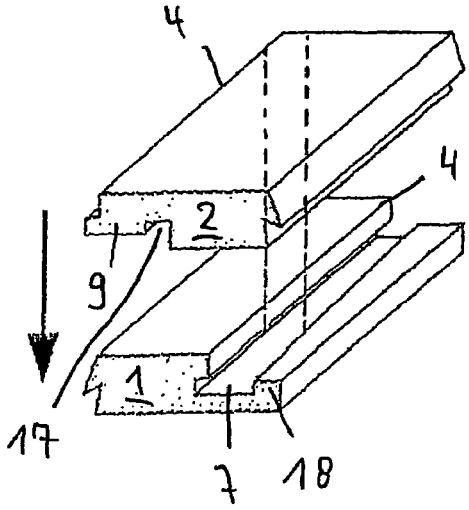
Figure 2B:
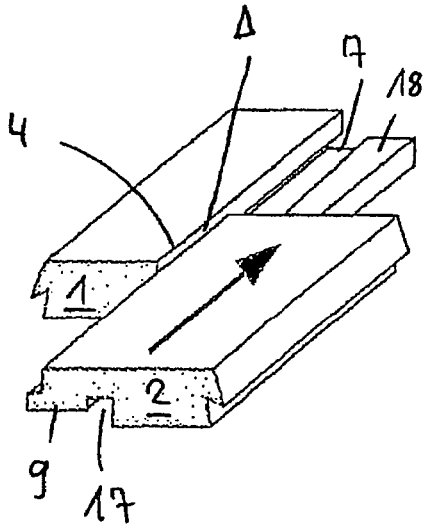
Figure 2C:
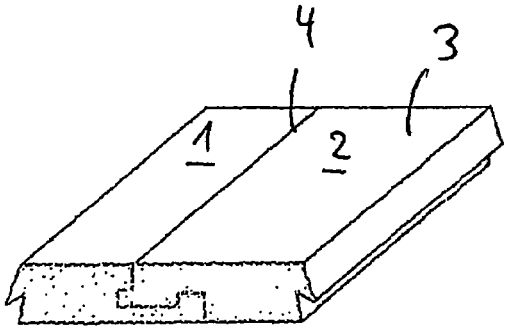
Figure 3:
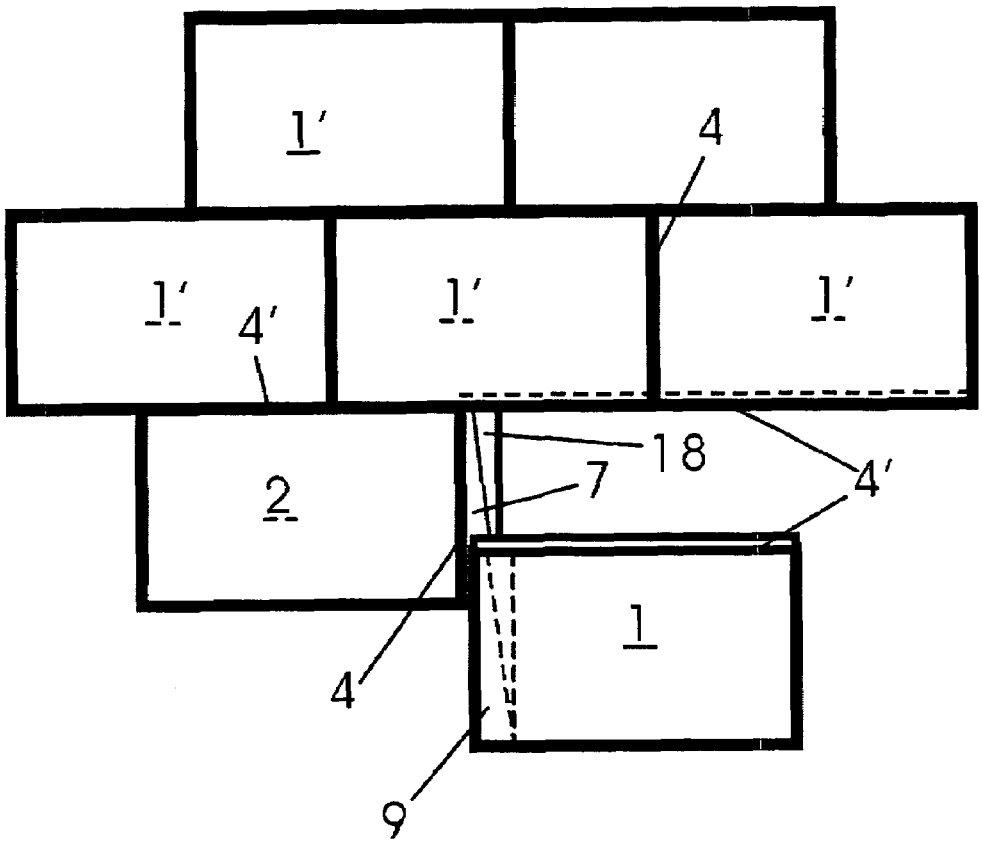
Figure 4:
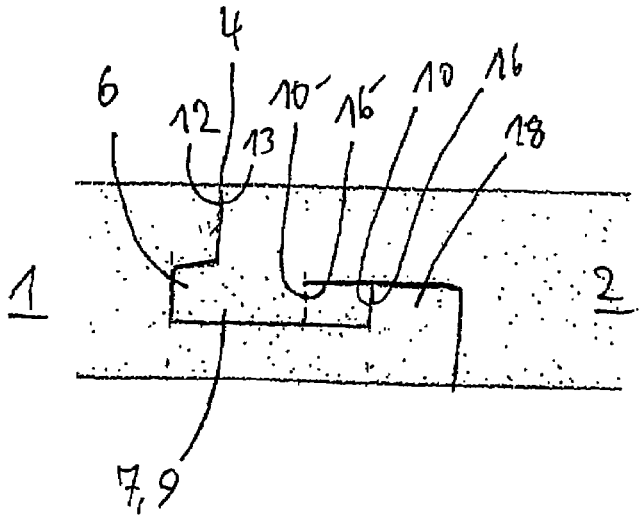
Figure 5:
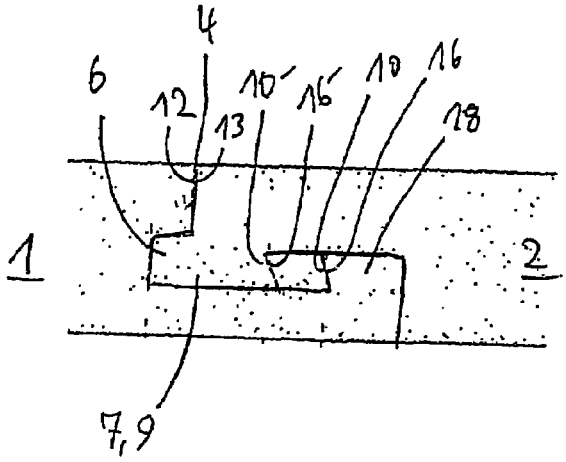
Figure 6:
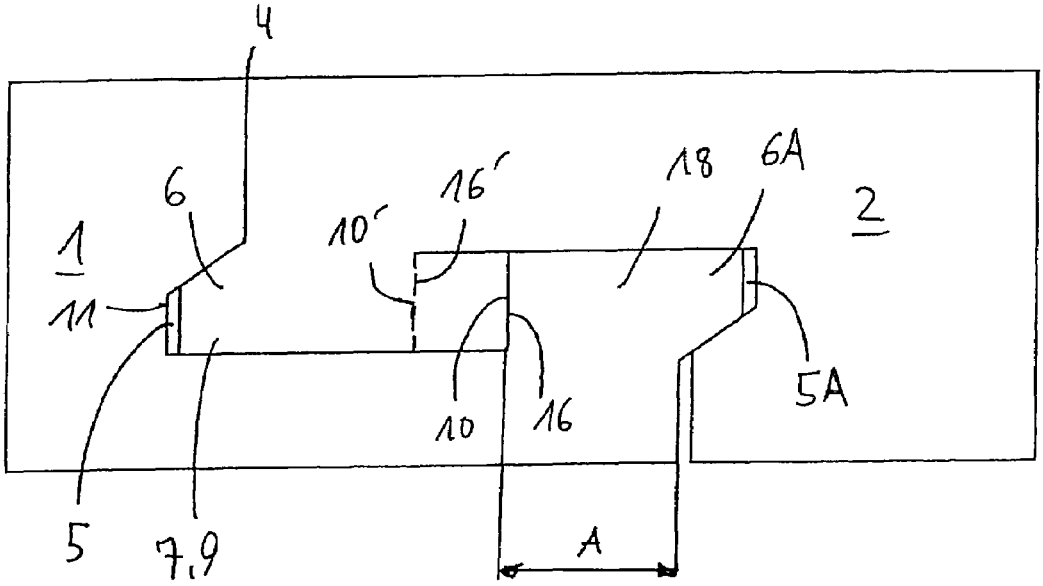
Figure 7:
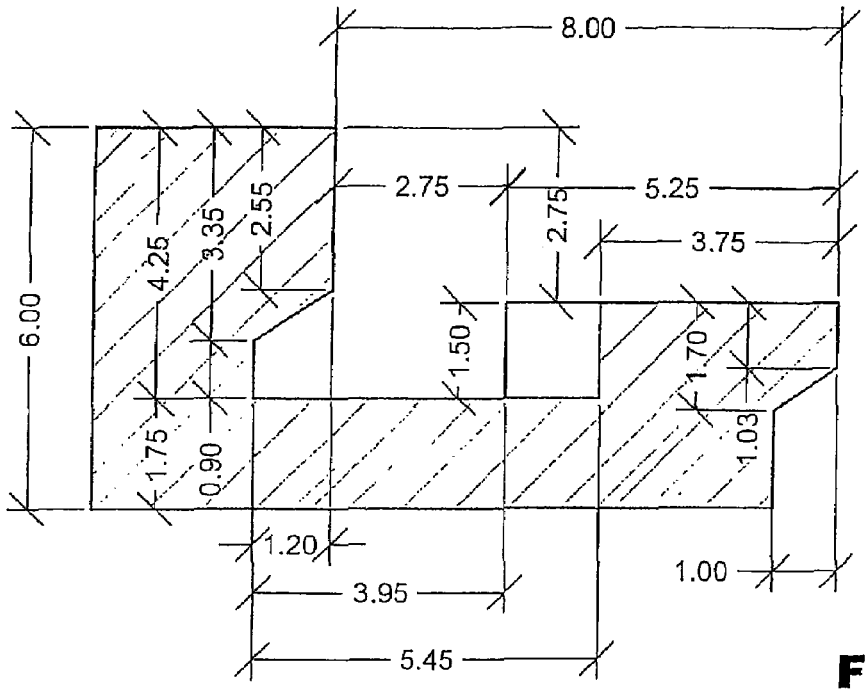
Figure 8:
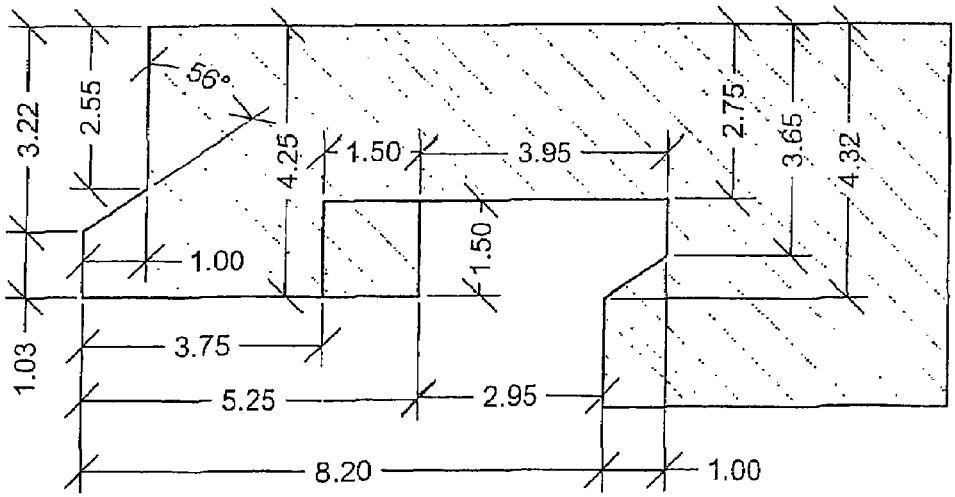

In the figures:

FIG. 1 shows the panels during lowering of the one panel into the initial position, FIGS. 2*a*-2*c* show the process of connecting by displacement, FIG. 3 shows a floor covering formed from the according to the invention in a top view FIG. 4 shows a cross section through the locking elements according to the invention FIG. 5 shows a cross section through the locking elements according to the invention in an alternative embodiment FIG. 6 shows a cross section through the locking elements according to the invention in a further alternative embodiment with an additional tongue on the bottom side and FIGS. 7 and 8 show the locking elements from FIG. 6 with dimensioning.

In the FIG. 2*c*, two boards 1 and 2 having laterally mounted locking means are shown. The locking means connect the boards 1 and 2 without adhesives. According to FIG. 2*c*, the boards 1 and 2 are connected or interlocked by positive fit in a perpendicular direction relative to the surface 3 of the boards 1 and 2 as well as in a parallel direction relative to the surface 3 of the board. Furthermore the two boards 1 and 2 are interlocked in a perpendicular direction relative to the common connecting joint 4. A displacement of the board 1 relative to the board 2 in a parallel direction relative to the common connecting joint 4 is possible in a limited extent, as will later be explained in connection with FIG. 1.

In the initial position or intermediate position, there may be a play "Δ" at the common connecting joint 4. Because of the play, the boards can be pulled apart a little (corresponding to the size of the play), namely in a perpendicular direction relative to the common connecting joint 4 and parallel to the surface 3. The locking elements according to FIG. 2*b* are made in such a way that, starting from an initial position, a final position in which there is no play between the boards 1 and 2 is reached by displacement within a plane parallel relative to the common connecting joint. Furthermore, the locking elements according to FIG. 2*b* are made in such a way that the board 2 can be lifted in a perpendicular direction in the initial position shown, i.e., that no perpendicular locking has yet taken place. This is not possible anymore in the intermediate position.

FIG. 1 shows two boards according to the invention before they are brought into the initial position. The first board 1 which has already been laid has at its right side edge the locking elements comprising horizontal lateral groove 5, perpendicular groove 7, and second locking element 18. These substantially comprise a perpendicular groove 7 extending in a perpendicular direction relative to the surface 3 of the board which groove is limited by lateral wall surfaces 11 and 10. Towards the left, i.e., in the direction of the interior of the boards, the perpendicular groove 7 merges into a horizontal lateral groove 5 which thus permits an undercut under the board's surface 3. Thus, the bottom of the perpendicular groove 7 together with the groove trough of the horizontal lateral groove 5 in this case forms a common flat surface 51.

Furthermore, the lateral wall surface 11 of the perpendicular groove 7 at the same time forms the boundary of the lateral groove 5. On the other side, the perpendicular groove 7 is limited by lateral wall surface 10. This wall surface 10, just like the corresponding lateral wall surface 16 of the second board 2, has the special feature that it does not run parallel to the joint 4 which forms the visible narrow side of the boards 1 and 2 and which is defined by the encounter of the wall surfaces 12 and 13 formed perpendicular from the board surface 3 of the boards. Thus, the lateral wall surfaces 10 and 16 have the special feature that they are not formed like all other millings with an angle of 90° to the longitudinal edge of the panel.

According to the invention, a comparatively very great snap-together height and an optimal angle (90° to the surface of the board or dovetail-like) of the lateral wall surfaces 16, 10 can be realized at a small thickness, without the occurrence of compression forces, shear forces, splitting forces or bending forces. The snap-together height is the height of the lateral wall surfaces 16 and 10 that are in contact with each other. The second board 2 has corresponding connecting locking element 9, lateral tongue 6, and second perpendicular groove 17. A perpendicular locking element 9 leads downwards away from the surface 3 of the board, which perpendicular locking element 9 can get into the perpendicular groove 7 of the first board 1 similar to a tongue, when the second board 2 is lowered onto the first board 1, the two boards overlapping to about $\frac{1}{3}^{rd}$ of the length of the common joint 4. The width of the perpendicular locking element varies wedge-like over the length of the board. Its course is also adapted to the wedge-shaped course of the lateral wall surface 10 of the perpendicular groove 7 of the first board, so that the respective lateral walls wall surfaces 10 and 16 serve as gliding surfaces during the displacement of the two boards along the common joint 4. The wedge-shape makes the pushing together of the boards with great force.

In order to make a lowering of the two boards into the initial position possible it is necessary that the width of the perpendicular locking element 9 of the second board 2 at the rear end of the end of the board 2 is smaller than the width measured between the lateral walls wall surfaces 13 and 10 of the perpendicular groove 7 in the front third of the first board 1.

The second board 2 also has, as locking element 9 that has an effect in the vertical direction, a lateral tongue 6 that has an effect in the parallel direction relative to the surface 3 of the board. The bottom side of the lateral tongue 6 together with the bottom side of the perpendicular locking element 9 forms a flat bottom surface 61. The top side of the lateral tongue 6 is slightly chamfered just like the upper groove cheek of the horizontal lateral groove 5 of the lower board 1 in order to facilitate an introduction of the lateral tongue 6 into the horizontal lateral groove 5. Thus, lower manufacturing tolerances must be adhered to. These chamferings can be seen more clearly in FIGS. 6 to 8.

These chamferings also have advantages with regard to production technique. The milling spindles can be tilted and can thus use the space that has become available because of the chamferings as room for maneuvering. Thus, the lateral wall surfaces 10 and 16 are not damaged during the run since the milling need not take place in direct proximity to the lateral wall surface 10 and corresponding lateral wall surface 16.

Furthermore, these chamferings have the advantage that the lateral end of the lateral tongue 6 need not contact the lateral wall surface 11 in the bottom of the groove, but rather is clamped wedge-like between the groove cheeks of the horizontal lateral groove 5. Because of the thus increased contact area, a particularly strong connection is achieved.

A second perpendicular groove 17 extends perpendicularly upwards from the perpendicular locking element 9 and is able to receive the second locking element 18 of the lower board. By providing a plurality of groove-tongue connections, more contact surfaces, for example 12, 13, 10, 16, 11, 15 are provided, whereby the connection is made more stable and whereby, in particular, the common joint 4 can be closed free of play. This is then also secure if moments are applied.

The establishment of the connection is illustrated by means of the FIGS. 2*a* to 2*c*. First, the new board 2 must be positioned over the laid board 1 such that the two overlap by around $1/3^{rd}$ of the length of the board. Then, the new board 2 is lowered such that the perpendicular tongue 9 can be lowered into the corresponding perpendicular groove 7 (FIG. 2*b*). This is possible in spite of the connection between the horizontal lateral groove 5 and the lateral tongue 6, since the perpendicular groove-tongue-connection is wedge-shaped. The common connecting joint 4 at this point in time still has a play "Δ".

In FIG. 2*b*, the second board 2 is shifted along the common connecting joint 4, the joint inevitably being closed due to the wedge-shaped faces of the connection between the perpendicular groove 7 and perpendicular locking element 9.

In FIG. 2*c*, the faces now adjoin intimately, i.e., over their whole length. The two boards are now fixed in a positive fit in all axes with the exception of a backward displacement along a common joint 4.

FIG. 3 now illustrates the laying of a flooring with the panels according to the invention. The boards that are already laid are marked 1' and 2. The common joints 4 at the end faces are effected by the lowering and displacing according to the invention along the common joint 4, while the longitudinal connecting joint 4' can be effected by bringing the boards closer in the plane, for examples by means of a snap-in or snap-together connection.

As explained under FIG. 2*a*, the board 1 that is to be newly laid is lowered, offset relative to the laid board 2, at its short end face so that the two locking means (perpendicular locking element 9 and perpendicular groove 7) of the boards can interlock. While the newly laid board 1 is displaced along the common joint 4 towards the already laid boards 1', the common joint 4 closes. At the same time, more or less as a byproduct, a snap-together connection is effected by the connecting joint 4' at the longitudinal sides. Thus, the lockings of joints 4, 4' at the end faces and at the longitudinal sides are effected at the same time by the displacement procedure.

When laying the final layer in the room, the procedure will be different from FIG. 3 because there is not enough room for displacing over about ⅔rds of the width of the elements. Therefore, all boards of the final row must be connected at their end faces to form a strip and then the entire strip must be pressed onto the flooring that is already laid so that the snap-together connections provided at the longitudinal sides can snap in. Only 0.5 to 2 cm of space are required for this.

FIG. 4 shows a detailed view of the connecting means locked in the final position. Here, the edge is shown where the perpendicular locking element 9 has the maximum width and where the second locking element 18, which is also wedge-shaped, has the minimal width. The aforementioned elements contact each other along a sliding surface formed by the lateral wall surfaces 10 and 16 that run in a wedge shape over the width of the board. The view shown therefore corresponds to a front view of the boards from FIGS. 1 and 2.

The contour of the non-visible lateral wall surfaces 10', 16∝ in the rear area of the board is indicated as a dotted line. The distance between the drawn lateral wall surface 10 and the indicated wall surface 10' therefore is the greatest possible play "Δ" around which the boards can be moved perpendicular to the common joint 4. The lateral wall surfaces 12 and 13 that abut in the area of the common joint 4 therefore can maximally have this distance "Δ". Furthermore, the play "Δ" is dimensioned such that it is larger than the length of the lateral tongue 6 protruding at the perpendicular locking element 9 in order to make a lowering of the perpendicular locking element 9 into the perpendicular groove 7 possible in the final position. Thus, the lateral tongue 6 is shorter than the play that can occur maximally at the common joint.

The invention can be formed as in the embodiment according to scale if the length of the lateral groove 5 amounts to 2 mm, the maximal width of the perpendicular groove 7 to 8.7 mm and its minimal width 5.8 mm, so that a play of 2.9 mm is the result. The maximum and minimum width of the second perpendicular locking element therefore amounts to 6.7 mm and 3.8 mm. A free length of 12.5 mm for the lower lip formed from the perpendicular groove 7 and the perpendicular second locking element 18 is the result. A length of the lateral tongue 6 of 2 mm for the vertical locking produces a great closing strength and secure locking that is not achieved in known panels.

As regards dimensioning and reference numerals, FIG. 5 corresponds to FIG. 4, however, the lateral wall surfaces 10 and 16 that serve as sliding areas are undercut similar to a dovetail so that a tensile force is exerted upon the connection. Thus, the two lateral wall surfaces 10, 16 hook together so that a downward deflection is not possible even if strong bending moments are exerted on the connections.

The further exemplary embodiment from FIG. 6 also corresponds to FIG. 4 as regards dimensioning and reference numerals, however, an additional lateral tongue 6A is provided on the first board 1 for reaching into an additional lateral groove 5A in the second board 2. In design and function, they correspond to the lateral horizontal tongue 6 or the horizontal lateral groove 5 already described above of the corresponding other boards 2, 1. The additional groove-tongue-connection 5A, 6A on the bottom side of the boards prevents the lower groove cheek evading the lateral groove 5 under tensile stress. The lock against an offset in height is therefore effected twice.

It can further be seen in FIG. 6 that the lateral end of the lateral tongue 6 does not contact the lateral wall surface 11 in the bottom of the lateral groove 5 but is clamped wedge-like between the groove cheeks of the lateral groove 5. In all, it is found that in this embodiment the connected boards 1, 2 have a common course of the profile that is substantially point-symmetric, at least in the area of the horizontal tongues 6, 6A and grooves 5, 5A.

The size of the smallest cross section, via which the perpendicular locking element 9 and the second locking element 18 connect with the upper lip of the second board 2 respectively with the upper lip of the first board 1, determines the total strength of the connection in all exemplary embodiments. This area is sheared off when the connection is put under stress until breaking. If the cross section represented in FIG. 6 by a measure of length A is made larger, then the connection becomes stronger.

The concrete dimensioning for a connection produced according to FIG. 6 can be seen from FIGS. 7 and 8. The value for measure A is therefore dependent on the course of the lateral wall surfaces 10 and 16 or 10' and 16' (5.25−1=4.25 mm or 3.75−1=2.75 mm). For the panels and thicknesses specified according to the invention, a value of 2-10 mm, preferably 2.5-7 mm, and particularly preferred, 2.5-5.5 mm was found.

The invention claimed is:

1. A structure comprising of at least first, second and third identical boards having planar surfaces and laterally mounted locking elements along a first common joint, said locking elements being wedge-shaped and having a width relative to the first common joint that decrease entirely along the length of the boards in a linear manner or increase entirely along the length of the boards in a linear manner, wherein the locking elements are made in such a way that, simultaneously, by displacing the first board relative to the second board along the first common joint, the first board can be connected with the second board in a positive fit along the first common connecting joint, both in a perpendicular direction relative to the planar surface of the board, as well as in a parallel direction relative to the planar surface of the board, and, at the same time, in a perpendicular direction relative to the first common joint, and the first board can be connected with the third board in a positive fit along a second common connecting joint, at least in a perpendicular direction relative to the surface of the board.

2. The structure according to claim 1, wherein all or some of the locking elements are made in such a way that the displacement can take place exclusively in one plane that is parallel relative to the surface of the boards.

3. The structure according to claim 2, wherein the first common connecting joint runs in a perpendicular direction relative to the second common connecting joint.

4. Boards having laterally mounted locking elements with which two boards can be connected with each other laterally in an adhesive-free manner by positive fit, said boards having planar surfaces and laterally mounted locking elements along a first common joint, said locking elements being wedge-shaped and having a width relative to the first common joint that decrease entirely along the length of the boards in a linear manner or increase entirely along the length of the boards in a linear manner, wherein the locking elements are made in such a manner, that there is an initial position into which the boards can exclusively be brought by lowering in a vertical direction, wherein the first common joint is formed between the boards in which a play occurs, and there is a final position reached by displacing the first board relative to the second board along a first common joint in which the boards are interlocked by positive fit in a vertical direction and in which no play occurs at the first common joint and wherein the panels may be connected with each other in an adhesive-free manner.

5. Boards according to claim 4, wherein the locking elements are such that the boards can be brought into the initial position when, along the common connecting joint, they are arranged offset relative to one another by more than 50% and less than 100%.

6. Boards according to claim 5, wherein there is an intermediate position in which the boards, at least in a vertical direction, are interlocked by positive fit and in which a play occurs at the common joint of the two boards.

7. Boards according to claim 6, wherein a board, as a locking element, has a perpendicular groove that is inserted in a perpendicular direction relative to the planar surface, and the other board has at least a corresponding protruding perpendicular locking element which arrives in the perpendicular groove when the boards are in the initial position, wherein the perpendicular groove and/or a lateral boundary of the perpendicular groove, at least in part, have a course that does not run parallel relative to the common joint, and/or the perpendicular locking element and/or a lateral boundary of the perpendicular locking element at least in part have such a course that does not run parallel relative to the common joint.

8. Boards according to claim 7, wherein, in the final position, a lateral boundary of the perpendicular groove adjoins a lateral boundary of the perpendicular locking element intimately.

9. Boards according to claim 8, wherein at least one lateral boundary of the perpendicular groove and/or a lateral boundary of the perpendicular locking element is formed wedge-shaped, has such a course relative to the common joint that the distance to the common joint decreases or increases along the joint in a linear manner.

10. Boards according to claim 9, wherein there is at least one contact area between two locking elements which area runs in a perpendicular direction relative to the surface.

11. Boards according to claim 9, wherein there is at least one contact area between two locking elements formed by undercuts.

12. Boards according to claim 9, wherein one board laterally has, as a locking element, at least one groove and another board laterally has at least one tongue.

13. Boards according to claim 9, wherein the bottom surface of a lateral tongue forms a continuous flat surface with the bottom of a vertical locking element.

14. Boards according to claim 9, wherein a bottom groove-cheek of a lateral groove forms a flat surface with the bottom of the perpendicular groove.

15. Boards, according to claim 9, that can be connected by means of a paste or, in particular, adhesive sealing compound and/or an adhesive between two interlocked boards.

16. Boards according to claim 9, having a moisture repellant paste or adhesive mass between two boards which adjoins the surface of the boards.

17. Boards according to claim 9, wherein the boards are laminate panels.

18. Boards according to claim 9, which are part of a floor covering.

19. A method for connecting at least first, second and third boards having planar surfaces with laterally mounted locking elements, said locking elements being wedge-shaped and having a width relative to a first common joint that decrease entirely along the length of the boards in a linear manner or increase entirely along the length of the boards in a linear manner, in particular of boards comprising the steps of: displacing the first board relative to the second board along the first common connecting joint, wherein simultaneously the first board being connected with the second board in a positive fit along the first common connecting joint, both in a perpendicular direction relative to the planar surface of the board, and in a parallel direction relative to the surface of the board, and, at the same time, in a perpendicular direction relative to the first common connecting joint, and the first board being connected with the third board in a positive fit along a second common connecting joint, at least in a perpendicular direction relative to the planar surface of the board.

20. The method according to claim 19, wherein the displacement occurs exclusively in one plane parallel relative to the surface of the board.

21. The method according to claim 20, wherein the first connecting joint runs in a perpendicular direction relative to the second common connecting joint.

22. A method for connecting at least first and second boards with laterally mounted locking elements, said locking elements being wedge-shaped and having a width relative to a first common joint that decrease entirely along the length of the boards in a linear manner or increase entirely along the length of the boards in a linear manner, wherein two of the boards being connected laterally by positive fit in an adhesive-free manner, comprising the following steps:

bringing the boards into an initial position, in particular, exclusively by lowering in a vertical direction, wherein the common joint is formed between the boards in which a play occurs, and bringing the boards into a final position, in which the boards are interlocked in a vertical direction by positive fit, and in which no play occurs at the first common joint and the panels are connected in an adhesive-free manner.

23. The method according to claim 22, wherein the boards are brought from the initial position into the final position by displacement along the common connecting joint.

24. Boards according to claim 4, wherein the locking elements are such that the boards can be brought into the initial position when, along the common connecting joint, they are arranged offset relative to one another by more than 66% and less than 80%.

* * * * *

UNITED STATES PATENT AND TRADEMARK OFFICE

CERTIFICATE OF CORRECTION

PATENT NO. : 7,600,354 B2
APPLICATION NO. : 10/561106
DATED : October 13, 2009
INVENTOR(S) : Franz Knauseder It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 123 days.

Signed and Sealed this

Fifth Day of October, 2010

David J. Kappos

David J. Kappos
*Director of the United States Patent and Trademark Office*